US011098480B2

(12) United States Patent
Wong

(10) Patent No.: US 11,098,480 B2
(45) Date of Patent: Aug. 24, 2021

(54) HOLLOW FLOOR SLAB FORMWORK, HOLLOW FLOOR SLAB STRUCTURE AND METHOD FOR CONSTRUCTING HOLLOW FLOOR SLAB STRUCTURE

(71) Applicant: Wai Hong Wong, Taipa (CN)

(72) Inventor: Wai Hong Wong, Taipa (CN)

( * ) Notice: Subject to any disclaimer, the term of this patent is extended or adjusted under 35 U.S.C. 154(b) by 105 days.

(21) Appl. No.: 16/478,335

(22) PCT Filed: Jan. 4, 2018

(86) PCT No.: PCT/CN2018/071335

§ 371 (c)(1),
(2) Date: Jul. 16, 2019

(87) PCT Pub. No.: WO2018/133672

PCT Pub. Date: Jul. 26, 2018

(65) Prior Publication Data

US 2019/0383008 A1 Dec. 19, 2019

(30) Foreign Application Priority Data

Jan. 22, 2017 (CN) ..... 201710053751.3

(51) Int. Cl.
*E04B 5/36* (2006.01)
*E04B 5/32* (2006.01)

(52) U.S. Cl.
CPC ..... *E04B 5/36* (2013.01); *E04B 5/326* (2013.01)

(58) Field of Classification Search
CPC . B28B 7/164; E04B 5/36; E04B 5/326; E04B 5/32; E04B 5/40; E04G 11/46; E04F 2203/04
See application file for complete search history.

(56) References Cited

U.S. PATENT DOCUMENTS 1,025,536 A * 5/1912 Nolan ..... E04B 5/326 52/577
1,507,721 A * 9/1924 Waite ..... E04B 5/326 52/577

(Continued)

FOREIGN PATENT DOCUMENTS

CN 203876017 10/2014
CN 204370710 6/2015

(Continued)

*Primary Examiner* — Gisele D Ford
(74) *Attorney, Agent, or Firm* — Cozen O'Connor

(57) ABSTRACT

The present invention provides a hollow floorslab formwork, a hollow floorslab structure and a construction method of hollow floorslab. The hollow floorslab structure is formed by splicing together a plurality of hollow floorslab formworks, and the hollow floorslab formworks each comprise a flat plate portion (1). A lower portion of the flat plate portion is provided with a plurality of supporting legs (4), and an outer edge of the flat plate portion is provided with a frame (2) comprising a plurality of protective plates (21, 22, 23,24). The protective plates are each provided with a reversely-fastened plate (31, 32), and adjacent hollow floorslab formworks are spliced together by fastening the reversely-fastened plates on the protective plates. The construction method comprises the following steps: a first hollow floorslab formwork is laid first; other periphery on a former hollow floorslab formwork, except the periphery provided with a reversely-fastened plate, is spliced with a latter hollow floorslab formwork, and the reversely-fastened plate of the latter hollow floorslab formwork is fastened on the protective plate of the former hollow floorslab formwork.

15 Claims, 7 Drawing Sheets

(56) References Cited

U.S. PATENT DOCUMENTS

| | | | | |
|---|---|---|---|---|
| 4,726,159 | A * | 2/1988 | Stohs | E04B 5/40 174/489 |
| 5,105,595 | A * | 4/1992 | Tokei | E04B 5/48 52/169.5 |
| 9,625,163 | B2 * | 4/2017 | Larson | F24D 13/02 |
| 2004/0231272 | A1 * | 11/2004 | Patrick | E04B 5/40 52/508 |
| 2008/0035830 | A1 | 2/2008 | O'Grady | |
| 2009/0272876 | A1 * | 11/2009 | McNamara | E04G 17/02 249/192 |
| 2015/0308116 | A1 * | 10/2015 | Bogh | E04B 5/40 52/579 |

FOREIGN PATENT DOCUMENTS

| | | |
|---|---|---|
| CN | 106906934 | 6/2017 |
| CN | 206477488 | 9/2017 |

* cited by examiner

HOLLOW FLOOR SLAB FORMWORK, HOLLOW FLOOR SLAB STRUCTURE AND METHOD FOR CONSTRUCTING HOLLOW FLOOR SLAB STRUCTURE

PRIORITY CLAIM

This is a U.S. national stage of application No. PCT/CN2018/071335, filed on Jan. 4, 2018. Priority is claimed on Chinese Application No. CN 201710053751.3, filed Jan. 22, 2017, the content of which is incorporated here by reference.

FIELD OF THE INVENTION

The present invention relates to the field of building construction and, more particularly, to a hollow floorslab formwork, a hollow floorslab structure and a construction method of the hollow floorslab structure. The present invention is based on the Chinese invention patent application with the application date on Jan. 22, 2017 and the application number of CN201710053751.3, the contents of which are incorporated herein by reference.

BACKGROUND OF THE INVENTION

The leakage-proof roof is a typical portion of a building. For example, Chinese utility model patent with the patent number of CN201420796966.6 discloses a leakage-proof roof. This leakage-proof roof comprises a floorslab layer, a waterproof membrane layer, a cement-sand layer, a thermal insulation layer and a concrete layer, and the thermal insulation layer is an empty space structure which cooperates with surrounding walls and the layer surface to enclose a closed chamber. The leakage-proof roof also comprises an airflow circulation system having a chamber, an intake pipe and an exhaust pipe. The intake pipe is in communication with the atmosphere and the chamber, and the exhaust pipe is in communication with the atmosphere and the chamber. The intake pipe and the exhaust pipe are correspondingly arranged on opposite ends of the leakage-proof roof. The intake pipe has a light-colored outer surface, and the exhaust pipe is made by the heat conducting material and has a dark outer surface. The thermal insulation layer is spliced together by thermal insulation bricks. The thermal insulation bricks each comprise a rectangular plate portion, and a supporting pillar portion extends from each of the four corner portions and the middle portion on a plate surface of the rectangular plate portion.

However, the problem with such a leakage-proof roof is that thermal insulation bricks add greatly to the weight of the roof, and the weight of the thermal insulation bricks and the weight of the concrete layer not only render the leakage-proof roof incompatible with the requirements of some building design, but also bring certain load-bearing risks to buildings. Moreover, after thermal insulation bricks are laid, cement needs to be filled between them so as to meet the requirement of leakage prevention. As such, the construction process of the leakage-proof roof is increased in number, such that the construction is rendered more difficult and time consuming.

Furthermore, the existing sound insulating floorslab is a hollow floorslab in which expandable polystyrene sphere arrays are laid in the concrete layer and steel bars are arranged vertically and horizontally, and sound insulating effects are achieved by changing the sound transmission area of the concrete in the floorslab as well as the medium. However, the problem with such a sound insulating floorslab is that in the concrete unit space in which expandable polystyrene spheres are arranged, the cross-sectional area of the concrete still accounts for 40% to 50%, such that sound insulating effects are poor.

Technical Problem

It is a first invention object of the present invention to provide a lightweight hollow floorslab formwork featured by convenient construction and having leakage-proof and sound insulating effects.

It is a second invention object of the present invention to provide a lightweight hollow floorslab structure featured by convenient construction and having leakage-proof and sound insulating effects.

It is a third invention object of the present invention to provide a construction method of hollow floorslab featured by convenient construction.

Technical Solution

The hollow floorslab formwork provided by the first invention object of the present invention comprises a flat plate portion, wherein a lower portion of the flat plate portion is provided with a plurality of supporting legs, the flat plate portion is provided with an opening directly above each of the supporting legs, the opening extends downwards to form a cavity in a middle portion of the supporting leg, and the supporting leg is sealed at its bottom portion; an outer edge of the flat plate portion is provided with a frame comprising a plurality of protective plates, and each periphery of the flat plate portion is provided thereon with one of the protective plates; at least one of the protective plates is provided thereon with a reversely-fastened plate extending outwards from an upper end of the protective plate in an obliquely downward manner.

A further solution is that the flat plate portion is a centrosymmetric tetragon or hexagon.

A further solution is as follows: half the peripheries of the flat plate portion constitute a periphery group, and the peripheries within the periphery group are connected end to end; each of the protective plates arranged on the periphery group is provided with the reversely-fastened plate.

A further solution is that the flat plate portion is a regular polygon, and a plurality of supporting legs are respectively arranged on a middle portion of the flat plate portion and at positions adjacent to corners thereof.

A further solution is that a reinforcing rib is connected between any two of the supporting legs, and the reinforcing rib is arranged on a bottom surface of the flat plate portion.

A further solution is that the protective plates each extend outwards from the periphery of the flat plate portion in an oblique manner, and the supporting legs each taper from the opening towards the bottom portion of the supporting leg to form an inverted table shape.

The hollow floorslab structure provided by the second invention object of the present invention comprises a plurality of hollow floorslab formworks spliced with one another, wherein the hollow floorslab formworks each comprise a flat plate portion, wherein a lower portion of the flat plate portion is provided with a plurality of supporting legs, the flat plate portion is provided with an opening directly above each of the supporting legs, the opening extends downwards to form a cavity in a middle portion of the supporting leg, and the supporting leg is sealed at its bottom portion; an outer edge of the flat plate portion is provided with a frame comprising a plurality of protective plates, and each periphery of the flat plate portion is provided thereon with one of the protective plates; at least one of the protective plates is provided thereon with a reversely-fastened plate extending outwards from an upper end of the protective plate in an obliquely downward manner; two adjacent hollow floorslab formworks are spliced together by fastening a reversely-fastened plate of a first one of the hollow floorslab formworks on a protective plate of another one of the hollow floorslab formworks.

In the construction method of hollow floorslab provided by the third invention object of the present invention, the hollow floorslab involved comprises a flat plate portion, wherein a lower portion of the flat plate portion is provided with a plurality of supporting legs, the flat plate portion is provided with an opening directly above each of the supporting legs, the opening extends downwards to form a cavity in a middle portion of the supporting leg, and the supporting leg is sealed at its bottom portion; an outer edge of the flat plate portion is provided with a frame comprising a plurality of protective plates, and each periphery of the flat plate portion is provided thereon with one of the protective plates; at least one of the protective plates is provided thereon with a reversely-fastened plate extending outwards from an upper end of the protective plate in an obliquely downward manner. The construction method comprises the following steps: a hollow floorslab formwork is laid; a former hollow floorslab formwork is spliced on a periphery thereof with a latter hollow floorslab formwork, and a reversely-fastened plate of the latter hollow floorslab formwork is fastened on a protective plate of the former hollow floorslab formwork.

Beneficial Effects

As for the hollow floorslab formworks of the present invention, after a first hollow floorslab formwork is laid, a former hollow floorslab formwork is spliced on a periphery thereof with a latter hollow floorslab formwork, and a reversely-fastened plate of the latter hollow floorslab formwork is fastened on a protective plate of the former hollow floorslab formwork. In this manner, a plurality of formworks are spliced together to form a tightly fastened hollow floorslab hollow layer. Then, concrete is poured within the frame of each hollow floorslab formwork; the concrete enters the cavity in the middle portion of each supporting leg by means of the opening, and covers the top of the floorslab formwork to eventually form a concrete layer. Seamless cooperation is achieved between adjacent floorslab formworks as they are connected together through the reversely-fastened plates. As such, the construction of the hollow layer and the concrete layer is simple and rapid. Moreover, the finally-formed leakage-proof roof is small in mass, the load-bearing problem is solved, and thus the applicability is high.

Besides, the hollow floorslab structure spliced by the hollow floorslab formworks may also be applicable to the design of sound insulation between storeys. The transmission of sound between storeys is mainly done through the supporting leg, and as the supporting leg occupies a small cross-sectional area in the space where it is located, better sound insulating effects can be achieved.

In addition, when the flat plate portion is disposed to be rectangular in shape, the hollow floorslab formworks after splicing will be of a grid arrangement; alternatively, when the flat plate portion is disposed to be hexagonal in shape, the hollow floorslab formworks after splicing will be of a honeycomb lattice distribution. This renders it more convenient for working personnel to identify during construction, thereby improving the construction efficiency.

Moreover, the ordered arrangement of reversely-fastened plates renders the splicing between hollow floorslab formworks simpler and rapider, which reduces the difficulty of construction, thereby improving the working efficiency.

Furthermore, the design of a regular polygon facilitates the arrangement of floorslab formworks and the calculation of area, and the arrangement of supporting legs endows hollow floorslab formworks with better mechanical properties.

Additionally, the outward inclination design of protective plates and the tapering design of supporting legs may achieve mutual stacking of hollow floorslab formworks, thereby rendering the transportation process more convenient.

Further, the arrangement of reinforcing ribs endows hollow floorslab formworks with better bending resistance abilities and improved mechanical properties.

BRIEF DESCRIPTION OF THE ACCOMPANYING DRAWINGS

The present invention is further illustrated below in conjunction with the accompanying drawings and embodiments.

DETAILED DESCRIPTION OF THE PREFERRED EMBODIMENTS

The first embodiment of the hollow floorslab formwork:

As the hollow floorslab structure provided by the present invention is formed by splicing together a plurality of structurally identical hollow floorslab formworks, a detailed description of the hollow floorslab formworks and an illustration of the hollow floorslab structure will be made in this embodiment.

Figure 1:
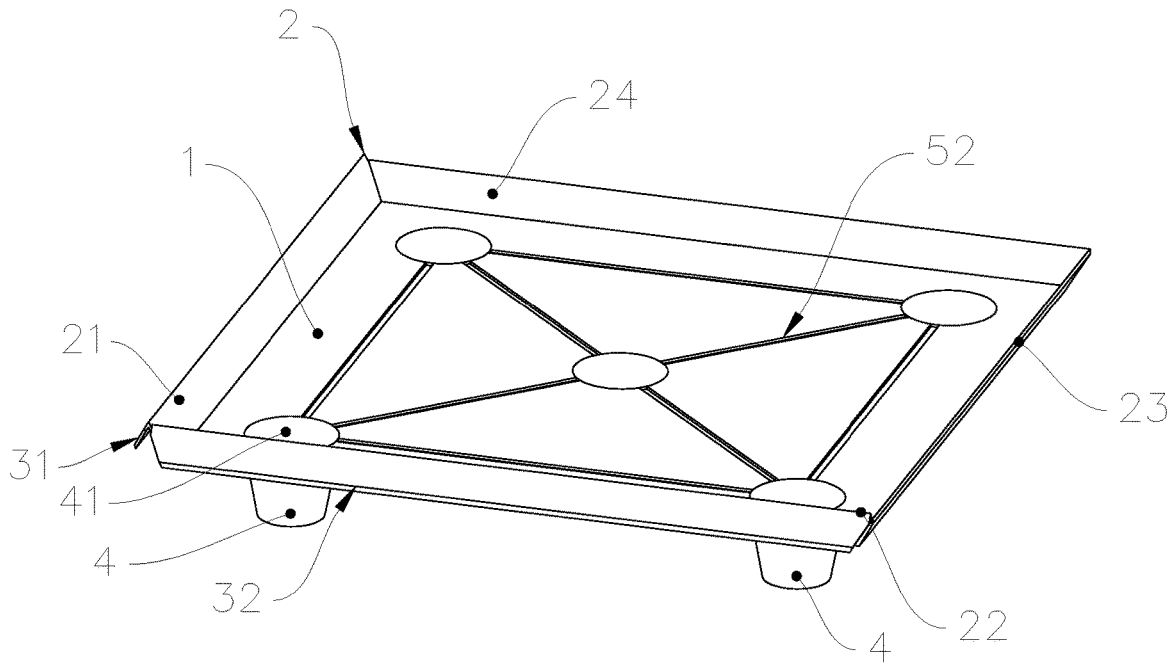
FIG. 1 is a structural view of a first embodiment of a hollow floorslab formwork of the present invention.

FIG. 1 is a structural view of the hollow floorslab formwork of the present invention. The hollow floorslab formwork is made by injection moulding of engineering plastics via a mold or pressing of thin aluminum sheets, and thus has a light weight. The hollow floorslab formwork comprises a flat plate portion 1, a frame 2 and supporting legs 4 arranged below the flat plate portion 1. The flat plate portion 1 is in the shape of a square in this embodiment, and the frame 2 is a projection surrounding the outer edge of the flat plate portion 1. The frame 2 comprises a first protective plate 21, a second protective plate 22, a third protective plate 23 and a fourth protective plate 24 that are respectively arranged on four peripheries of the flat plate portion 1, and the four protective plates arranged on the four peripheries are of an identical structure. Each protective plate extends from a first end of a corresponding periphery to a second end of the periphery, and adjacent protective plates are connected together, such that the four protective plates can constitute the frame 2. A first reversely-fastened plate 31 and a second reversely-fastened plate 32 are respectively arranged on the adjacent first protective plate 21 and second protective plate 22.

Figure 2:
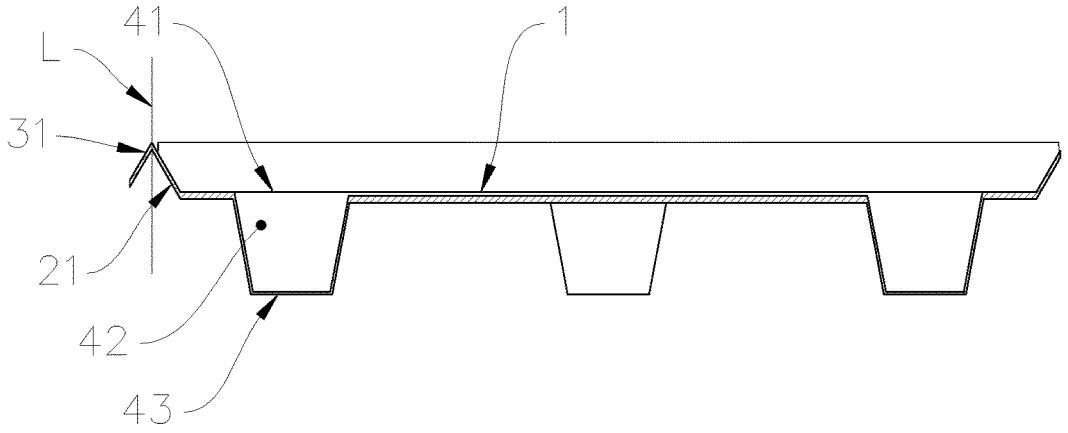
FIG. 2 is a cross-sectional view of the first embodiment of the hollow floorslab formwork of the present invention.

Referring to FIG. 2, FIG. 2 is a cross-sectional view of the hollow floorslab formwork of the present invention. In conjunction with FIG. 1, take the protective plate 21 as an example. The protective plate 21 extends outwards from the periphery of the flat plate portion 1 in an oblique manner. An upper end of the protective plate 21 is provided with a reversely-fastened plate 31 extending downwards and outwards in an oblique manner, and the inclination angle that the protective plate 21 forms with respect to a vertical plane L is equal to the inclination angle that the reversely-fastened plate 31 forms with respect to the vertical plane L. The reversely-fastened plate 31 extends from a length-direction front end of the protective plate 21 to a length-direction rear end of the protective plate 21, and the extension of the reversely-fastened plate 31 does not exceed the horizontal height where the upper surface of the flat plate portion 1 lies.

Five supporting legs 4 are connected to the lower portion of the flat plate portion 1. The positions adjacent to four corners of the square flat plate portion 1 are each provided with a supporting leg 4, a supporting leg 4 is arranged at the center of the flat plate portion 1, and the four supporting legs 4 located at the four corners are symmetrically arranged. The flat plate portion 1 is provided with an opening 41 directly above each of the supporting legs 4, the opening 41 extends downwards to form a cavity 42, and the supporting leg 4 is sealed at its bottom portion 43.

The supporting leg 4 tapers gradually from the opening 41 towards the bottom portion of the supporting leg 4 to form an inverted table shape. Specifically, the supporting leg 4 is in the shape of an inverted round table or truncated pyramid. Moreover, due to the arrangement of the cavity 42, the supporting leg 4 is provided with a circumferential wall, and the circumferential wall has a uniform thickness, thereby ensuring that the inclination degree of an inner wall surface of the supporting leg 4 is equal to that of an outer wall surface. Here, the size of the openings 41 and the inclination degree of the supporting legs 4 are supposed to ensure stacking of hollow floorslab formworks, such that the supporting legs of the hollow floorslab formwork located above can enter the openings 41. Similarly, the outward inclination design of protective plates 21 also facilitates the stacking of hollow floorslab formworks.

Figure 3:
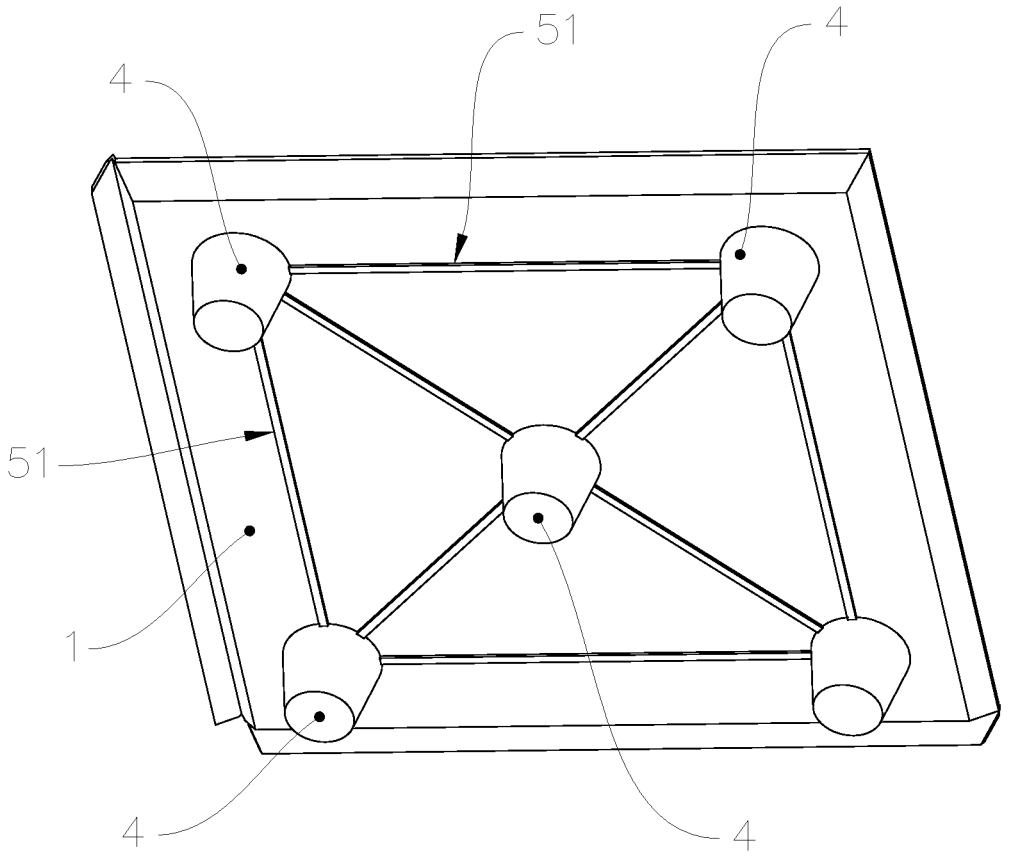
FIG. 3 is a structural view of the first embodiment of the hollow floorslab formwork of the present invention viewed from another perspective.

Referring to FIG. 3, FIG. 3 is a structural view of the hollow floorslab formwork of the present invention viewed from another perspective. On a bottom surface of the flat plate portion 1, a straight reinforcing rib 51 is arranged between any two of the supporting legs 4 for connection reinforcement. Moreover, as the hollow floorslab formwork is press-formed, a groove 52 (see FIG. 1) is correspondingly formed on the surface of the flat plate portion 1 while the reinforcing rib 51 is formed on the bottom surface of the flat plate portion 1.

Figure 4:
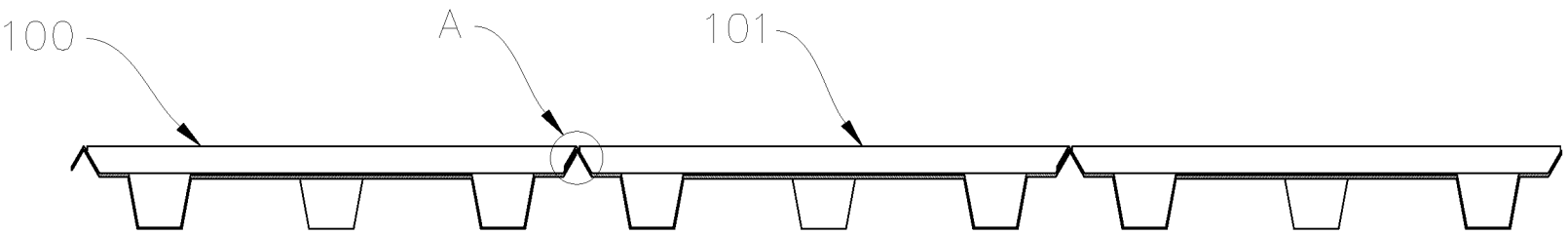
FIG. 4 is a connection relation view of the first embodiment of the hollow floorslab formwork of the present invention.
Figure 5:
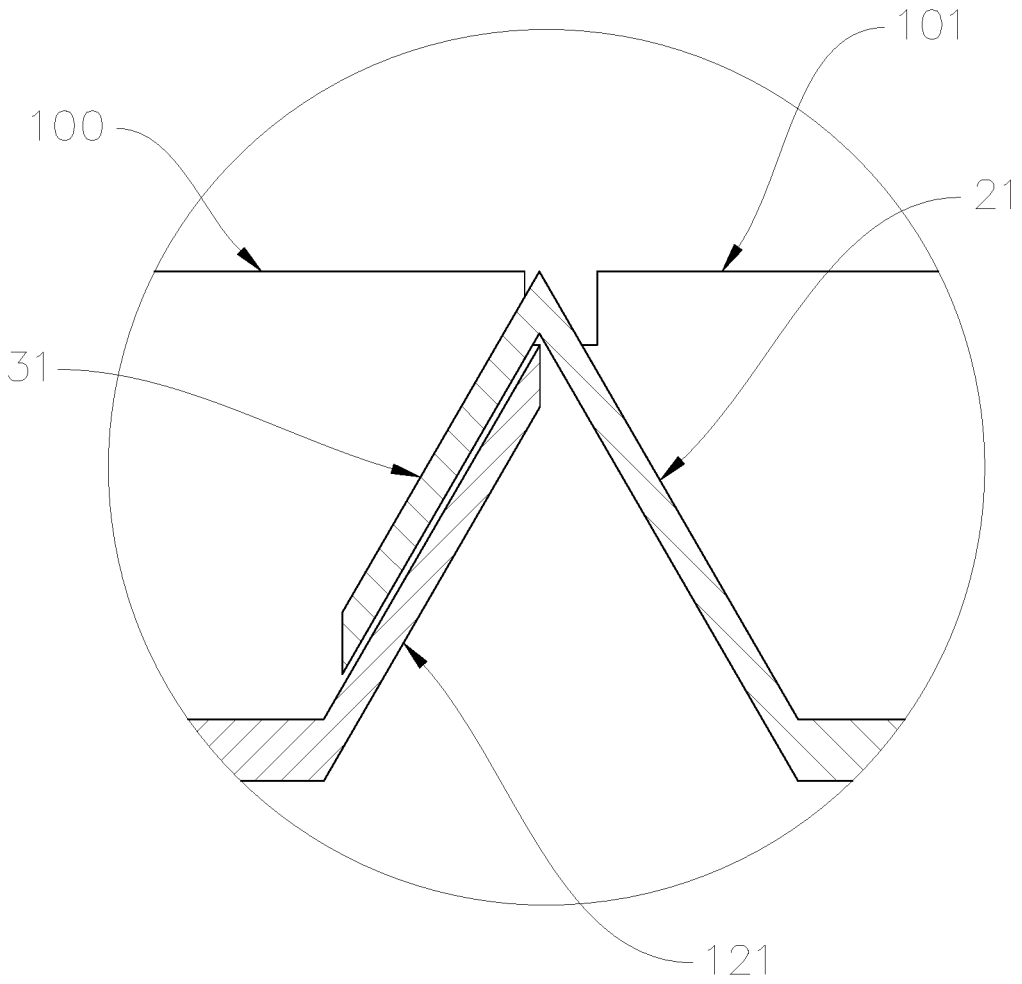
FIG. 5 is an enlarged view of Detail A in FIG. 4.

Referring to FIGS. 4 and 5, FIG. 4 is a connection relation view of the hollow floorslab formwork of the present invention, and FIG. 5 is an enlarged view of Detail A in FIG. 4. In conjunction with FIG. 1, the frame 2 is in the form of a square frame. Here, two adjacent protective plates are each provided thereon with a reversely-fastened plate, while the other two adjacent protective plates are not provided with reversely-fastened plates. When splicing is required for hollow floorslab formworks, it can be achieved by means of the cooperation of reversely-fastened plates with protective plates. When a hollow floorslab formwork 100 needs to be spliced with a hollow floorslab formwork 101, the hollow floorslab formwork 100 is first placed on the ground of a site to be laid; at this time, one side of the first protective plate 21 of the hollow floorslab formwork 101 that is provided with the reversely-fastened plate 31 is fastened on the first protective plate 121 of the hollow floorslab formwork 100 that is not provided with the reversely-fastened plate. As the reversely-fastened plate 31 is outwardly inclined with respect to the hollow floorslab formwork 101 to which it belongs, and with respect to the abutting hollow floorslab formwork 100, the inclination direction of the reversely-fastened plate 31 is consistent with that of the first protective plate 121, the reversely-fastened plate 31 is fastened on the first protective plate 121 in a hanging manner under the guiding fit. Meanwhile, the gap between the hollow floorslab formwork 100 and the hollow floorslab formwork 101 is blocked by the first protective plate 21 and the reversely-fastened plate 31.

Figure 6:
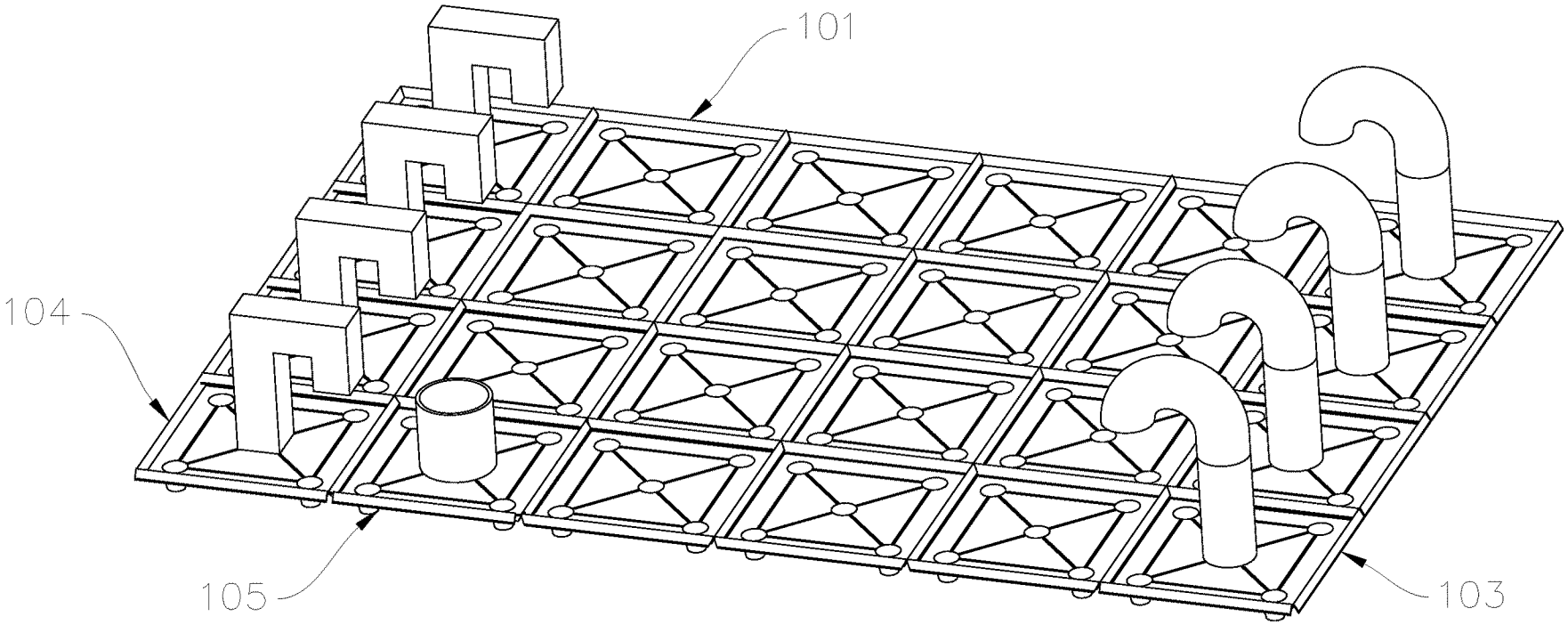
FIG. 6 is a structural view of a first embodiment of a hollow floorslab structure of the present invention.

Referring to FIG. 6, FIG. 6 is a structural view of an embodiment of the hollow floorslab structure of the present invention. A plurality of hollow floorslab formworks 101 are spliced together in a two-dimensional direction to form a hollow floorslab structure. With regard to one hollow floorslab formwork 101, half the protective plates arranged on the peripheries are taken to constitute a protective plate group, and two protective plates within this protective plate group are adjacent protective plates. In this manner, it can be ensured that when a plurality of structurally identical hollow floorslab formworks are spliced together, a fastening relationship between a reversely-fastened plate and a protective plate exists between any two of the hollow floorslab formworks. In other words, it can be ensured that no gap exists between any two of the hollow floorslab formworks.

Based on the hollow floorslab formwork, when its flat plate portion is provided with a conduit in communication with the spaces above and below the flat plate portion, a functionally different floorslab formwork can be formed. For example, when a wellhead is arranged on the middle portion of the flat plate portion, a hollow floorslab detection port formwork 105 is formed; alternatively, when the middle portion of the flat plate portion is provided thereon with a light-colored elbow conduit in communication with the spaces above and below the flat plate portion, a hollow floorslab convection air inlet 103 is formed, and when the middle portion of the flat plate portion is provided thereon with a dark elbow conduit in communication with the spaces above and below the flat plate portion, a hollow floorslab convection air outlet 104 is formed. If the hollow floorslab convection air inlet 103, the hollow floorslab convection air outlet 104 and the hollow floorslab detection port formwork 105 are added while the hollow floorslab formworks 101 are spliced together to form the hollow floorslab structure, and concrete is then poured above each formwork to form a concrete layer, a roof leakage-proof structure can be formed, and for specific working principles of this roof leakage-proof structure, reference may be made to the Chinese utility model patent having the patent number of CN201420796966.6.

In conjunction with FIG. 2, here, as the frame 2 arranged on the flat plate portion 1 of each of the hollow floorslab formwork 101, the hollow floorslab convection air inlet 103, the hollow floorslab convection air outlet 104 and the hollow floorslab detection port formwork 105 forms an accommodation space on each flat plate portion 1, and the accommodation space comprises a plurality of cavities 42 communicated by openings 41, concrete will enter the cavities 42 in the middle portions of the supporting legs 4 through the openings 41 when it is poured above the hollow floorslab formwork 101. Therefore, the solidified concrete layer has supporting legs. As the concrete layer plays a major supporting role, the hollow floorslab formwork 101 may be designed to be as light and thin as possible, thus further facilitating transportation and construction installation. Moreover, as the hollow floorslab is connected with the ground of the structural floorslab located below simply by the supporting legs 4, the sound transmission area is greatly reduced. If the hollow floorslab constructed by hollow floorslab formworks is used as an additional floorslab between storeys, certain sound insulating effects can be achieved.

Figure 7:
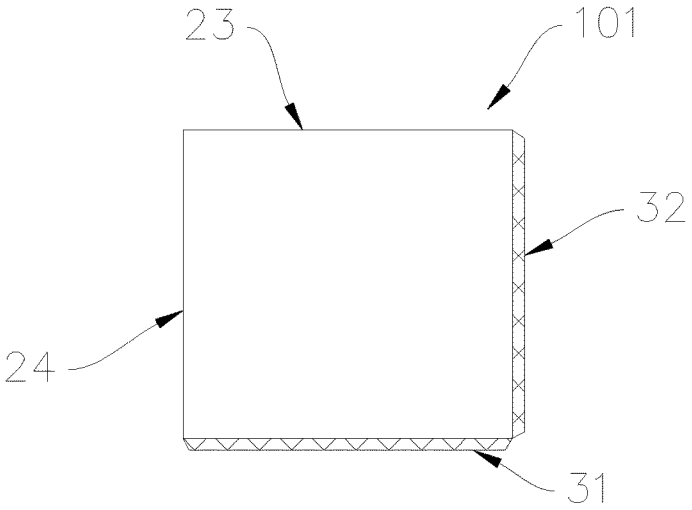
FIG. 7 is a structural schematic view of the first embodiment of the hollow floorslab formwork of the present invention.

Referring to FIG. 7, FIG. 7 is a structural schematic view of the first embodiment of the hollow floorslab formwork of the present invention. In a square hollow floorslab formwork 101, two adjacent peripheries constitute a periphery group. The protective plates on the two peripheries of the periphery group are provided respectively with a first reversely-fastened plate 31 and a second reversely-fastened plate 32, while the third protective plate 23 and the fourth protective plate 24 on two peripheries except the periphery group are not provided with reversely-fastened plates.

Figure 8:
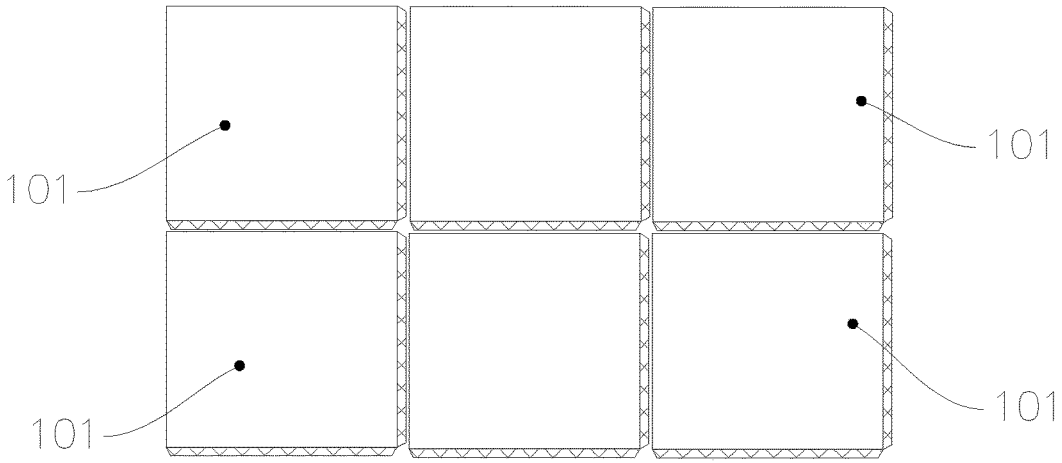
FIG. 8 is a first connection relation view of the first embodiment of the hollow floorslab formwork of the present invention.

Referring to FIG. 8, FIG. 8 is a first connection relation view of the hollow floorslab formwork of the present invention. In conjunction with FIG. 7, the periphery groups of all the hollow floorslab formworks 101 to be spliced are arranged towards the lower right corner. Moreover, during construction, a first hollow floorslab formwork 101 in the lower right corner is laid first; then, splicing is conducted at the left and upper sides thereof. This process is repeated until the splicing of the floorslab structure is completed. The periphery groups of all the hollow floorslab formworks 101 to be spliced are arranged in the same direction, which simplifies steps, thereby greatly reducing the probability of errors.

Figure 9:
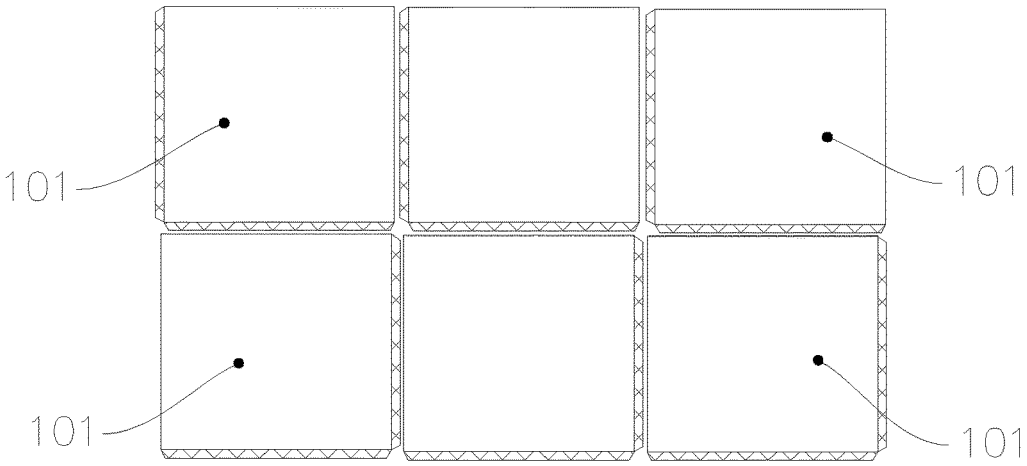
FIG. 9 is a second connection relation view of the first embodiment of the hollow floorslab formwork of the present invention.

Referring to FIG. 9, FIG. 9 is a second connection relation view of the hollow floorslab formwork of the present invention. In conjunction with FIG. 7, the periphery groups of all the hollow floorslab formworks 101 to be spliced in a first row are arranged towards the lower right corner, and the periphery groups of all the hollow floorslab formworks 101 to be spliced in a second row are arranged towards the lower left corner. This can likewise achieve the splicing of the hollow floorslab formwork structure.

Figure 10:
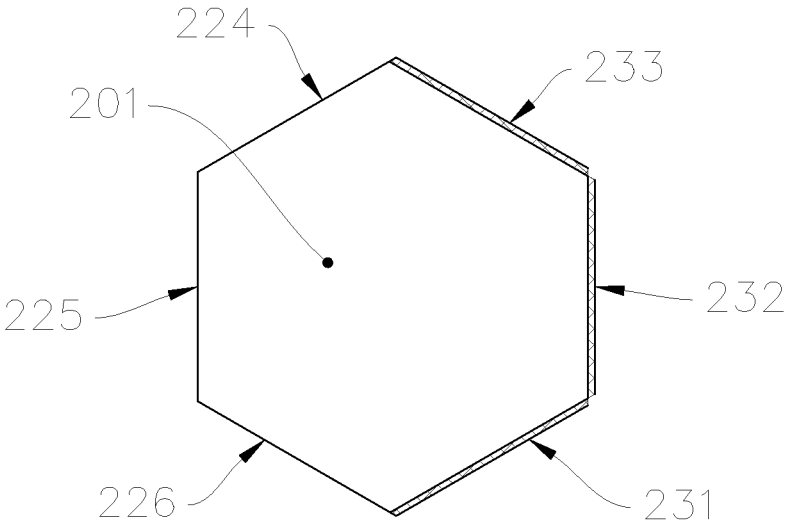
FIG. 10 is a structural schematic view of a second embodiment of the hollow floorslab formwork of the present invention.
Figure 11:
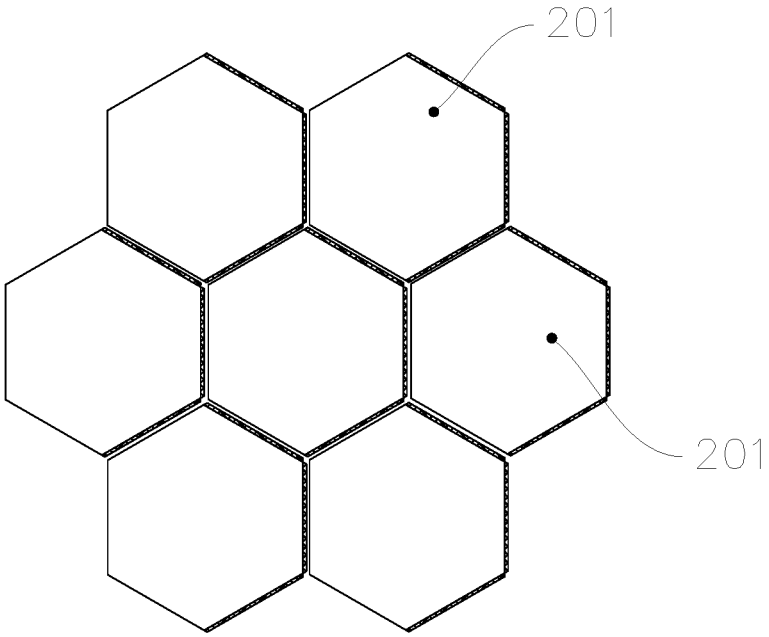
FIG. 11 is a connection relation view of the second embodiment of the hollow floorslab formwork of the present invention.

The second embodiment of the hollow floorslab formwork:

Referring to FIGS. 10 and 11, FIG. 10 is a structural schematic view of a second embodiment of the hollow floorslab formwork of the present invention, and FIG. 11 is a connection relation view of the second embodiment of the hollow floorslab formwork of the present invention.

In the present invention, in addition to being a square, the hollow floorslab formwork may also be any kind of centrosymmetric tetragon or hexagon. Take a regular hexagon as an example. The flat plate portion of the hollow floorslab formwork 201 is in the shape of a regular hexagon. The periphery group of the hollow floorslab formwork 201 consists of three adjacent peripheries on the right, and the three peripheries of the periphery group are provided respectively with a first reversely-fastened plate 231, a second reversely-fastened plate 232 and a third reversely-fastened plate 233. Moreover, another three peripheries of the hollow floorslab formwork 201, except the periphery group, are provided respectively with a fourth protective plate 224, a fifth protective plate 225 and a sixth protective plate 226. The specific structures of the frame and supporting legs of the hollow floorslab formwork 201 are exactly the same as the structures recited in the first embodiment, and thus detailed description thereof will be omitted.

During splicing of hexagonal hollow floorslab formworks 201, the periphery groups of all the hollow floorslab formworks 201 to be spliced face to the right, and the fourth protective plate 224, the fifth protective plate 225 and the sixth protective plate 226 on each hollow floorslab formwork 201, except the periphery group thereof, may be fastened to a new hollow floorslab formwork 201. This process may be repeated to complete the splicing of the hexagonal hollow floorslab formworks 201.

Certainly, the shape of the hollow floorslab formwork is not limited to a square or a regular hexagon. The hollow floorslab formwork may be in the shape of a centrosymmetric tetragon or hexagon. Half the peripheries are taken to constitute a periphery group. The peripheries within the periphery group are connected end to end, and the protective plate on each periphery within the periphery group is provided with a reversely-fastened plate.

Embodiment of the construction method of hollow floorslab structure:

The specific structure of the hollow floorslab formwork has been described in detail in the first embodiment of hollow floorslab formwork, and thus detailed description thereof will be omitted. Take a square hollow floorslab formwork as an example. When a hollow floorslab formwork structure is laid to form a thermal insulation layer or a sound insulating layer, a first hollow floorslab formwork is first laid at the reference position on a work site, and the periphery group of this hollow floorslab formwork, namely the sides provided with reversely-fastened plates, is arranged outwards. Then, two new hollow floorslab formworks are fastened on the first hollow floorslab formwork. The two new hollow floorslab formworks are respectively fastened on the protective plates on two peripheries, except the periphery group, of the first hollow floorslab formwork, and the orientation of the periphery groups of the two new hollow floorslab formworks is the same as that of the first hollow floorslab formwork, i.e., as shown in FIG. 8. Thereafter, a previously laid hollow floorslab formwork is used as a reference, and then, another two new hollow floorslab formworks are laid behind it. This process is repeated until a hollow floorslab formwork structure having a certain area is formed eventually.

Relative to the thermal insulation layer formed by five-leg thermal insulation bricks, which is employed in the Chinese utility model with the patent number of CN201420796966.6, the space where the supporting legs of the hollow floorslab structure formed by hollow floorslab formworks are located also forms an empty space structure, and the hollow floorslab structure having the empty space structure has the functions of air ventilation and sound insulation. Moreover, the weight of the hollow floorslab formwork is greatly reduced relative to the five-leg thermal insulation brick. Meanwhile, the hollow floorslab formworks achieve leakage prevention of gaps when they are fastened to one another. As such, unlike five-leg thermal insulation bricks, there is no need to achieve leakage prevention by filling cement between brick joints after laying. Due to the inexistence of the issue of excessive weight, the hollow floorslab structure has a high applicability. Furthermore, the outward inclination design of the hollow floorslab frame and the tapering design of the supporting legs achieve mutual stacking of hollow floorslab formworks, thereby rendering their transportation process more convenient.

Finally, it should be noted that what have been described above are merely preferred embodiments of the present invention and not used to limit the present invention. For those skilled in the art, various changes and alterations may be made to the present invention. For example, the hollow floorslab structure may be formed by seamlessly splicing together a plurality of hollow floorslab formworks having different contours. All the modifications, equivalent substitutions, improvements and the like, which are made within the spirit and principle of the present invention, shall be covered by the scope of protection of the present invention.

INDUSTRIAL APPLICABILITY

The hollow floorslab formwork of the present invention may be used to construct floorslab structures, such as leakage-proof rooftops. With the use of the floorslab structure having such a structure, no cement needs to be filled between adjacent floorslab formworks due to the seamless cooperation of the reversely-fastened plates, construction of the thermal insulation layer and the concrete layer is simple and rapid, the finally-formed leakage-proof roof is small in mass and has the characteristics of sound insulation and ventilation, the load-bearing problem is solved, and thus the applicability is high.

In addition, with the use of the hollow floorslab structure of the present invention, no cement is required during construction. As such, the construction process is simple, which, therefore, can improve the construction efficiency.

The invention claimed is:

1. A hollow floorslab formwork, wherein, the hollow floorslab formwork comprises:

a flat plate portion, a plurality of supporting legs being arranged so as to extend from an underside surface of the flat plate portion, the flat plate portion having an opening directly above each of the supporting legs, each opening extending downwards to form a cavity in a corresponding supporting leg, and each supporting leg being sealed at its bottom portion;

the flat plate portion having, at an outer edge of the flat plate portion, a plurality of peripheral edges, and being provided with a frame comprising a plurality of protective plates, each peripheral edge of the flat plate portion being provided thereon with one of the protective plates;

wherein at least one of the protective plates has, provided thereon, a reversely-fastened plate extending outwards from an upper end of the protective plate in an obliquely downward manner, and wherein the flat plate portion is shaped as a regular polygon having N corners and N sides, and the plurality of supporting legs equals N+1, wherein only one of the supporting legs is arranged at a center of said regular polygon, and wherein the remaining supporting legs are arranged only one to each corner of said regular polygon.

2. The hollow floorslab formwork of claim 1, wherein:

the regular polygon is a centrosymmetric tetragon or hexagon.

3. The hollow floorslab formwork of claim 2, wherein:

half the peripheral edges of the flat plate portion constitute a periphery group, and the peripheral edges within the periphery group are connected end to end; and each of the protective plates arranged on the periphery group is provided with the reversely-fastened plate.

4. The hollow floorslab formwork of claim 1, wherein:

the protective plates each extend outwards from a respective one of the peripheral edges of the flat plate portion in an oblique manner, and the supporting legs each taper gradually from the opening towards the bottom portion of the supporting leg to form an inverted table shape.

5. The hollow floorslab formwork of any one of claim 1, wherein:

a reinforcing rib is connected between at least two of the supporting legs, and the reinforcing rib is arranged on the underside surface of the flat plate portion.

6. A hollow floorslab structure, wherein, the hollow floorslab structure comprises:

a plurality of hollow floorslab formworks spliced with one another, wherein the hollow floorslab formworks each comprise:

a flat plate portion, a plurality of supporting legs being arranged so as to extend from an underside surface of the flat plate portion, the flat plate portion having an opening directly above each of the supporting legs, each opening extending downwards to form a cavity in a corresponding supporting leg, and each supporting leg being sealed at its bottom portion;

the flat plate portion having, at an outer edge of the flat plate portion, a plurality of peripheral edges, and being provided with a frame comprising a plurality of protective plates, each peripheral edge of the flat plate portion being provided thereon with one of the protective plates;

at least one of the protective plates has, provided thereon, a reversely-fastened plate extending outwards from an upper end of the protective plate in an obliquely downward manner, wherein the flat plate portion is shaped as a regular polygon having N corners and N sides, and the plurality of supporting legs equals N+1, wherein only one of the supporting legs is arranged at a center of said regular polygon, wherein the remaining supporting legs are arranged only one to each corner of said regular polygon, and wherein two adjacent hollow floorslab formworks are spliced together by fastening a reversely-fastened plate of a first one of the hollow floorslab formworks on a protective plate of another one of the hollow floorslab formworks.

7. The hollow floorslab structure of claim 6, wherein:

the regular polygon is a centrosymmetric tetragon or hexagon.

8. The hollow floorslab structure of claim 6, wherein:

half the peripheral edges of the flat plate portion constitute a periphery group, and the peripheral edges within the periphery group are connected end to end; and each of the protective plates arranged on the periphery group is provided with the reversely-fastened plate.

9. The hollow floorslab structure of claim 6, wherein:

the protective plates each extend outwards from a respective one of the peripheral edges of the flat plate portion in an oblique manner, and the supporting legs each taper gradually from the opening towards the bottom portion of the supporting leg to form an inverted table shape.

10. The hollow floorslab structure of claim 6, wherein:

a reinforcing rib is connected between at least two of the supporting legs, and the reinforcing rib is arranged on the underside surface of the flat plate portion.

11. A construction method of hollow floorslab, wherein the hollow floorslab comprises a plurality of hollow floorslab formworks, and the hollow floorslab formworks each comprise a flat plate portion, a plurality of supporting legs being arranged so as to extend from an underside surface of the flat plate portion, the flat plate portion having an opening directly above each of the supporting legs, the opening extends downwards to form a cavity in the supporting leg, and the supporting leg is sealed at its bottom portion;

the flat plate portion having, at an outer edge of the flat plate portion, a plurality of peripheral edges, and being provided with a frame comprising a plurality of protective plates, each peripheral edge of the flat plate portion being provided thereon with one of the protective plates;

at least one of the protective plates has, provided thereon, a reversely-fastened plate extending outwards from an upper end of the protective plate in an obliquely downward manner, wherein the flat plate portion is shaped as a regular polygon having N corners and N sides, and the plurality of supporting legs equals N+1, wherein only one of the supporting legs is arranged at a center of said regular polygon, wherein the remaining supporting legs are arranged only one to each corner of said regular polygon, and wherein: the construction method comprises the following steps:

laying a hollow floorslab formwork;

splicing a former hollow floorslab formwork on a peripheral edge thereof with a latter hollow floorslab formwork; and fastening a reversely-fastened plate of the latter hollow floorslab formwork on a protective plate of the former hollow floorslab formwork.

12. The construction method of hollow floorslab of claim 11, wherein:

the regular polygon is a centrosymmetric tetragon or hexagon.

13. The construction method of hollow floorslab of claim 11, wherein:

half the peripheral edges of the flat plate portion constitute a periphery group, and the peripheral edges within the periphery group are connected end to end; and each of the protective plates arranged on the periphery group is provided with the reversely-fastened plate.

14. The construction method of hollow floorslab of claim 11, wherein:

the protective plates each extend outwards from a respective one of the peripheral edges of the flat plate portion in an oblique manner, and the supporting legs each taper gradually from the opening towards the bottom portion of the supporting leg to form an inverted table shape.

15. The construction method of hollow floorslab of claim 11, wherein:

a reinforcing rib is connected between at least two of the supporting legs, and the reinforcing rib is arranged on the underside surface of the flat plate portion.

* * * * *